US006066015A

United States Patent [19]

Brown

[11] Patent Number: 6,066,015

[45] Date of Patent: May 23, 2000

[54] METHOD AND SYSTEM FOR ANCHORING A BUOY VIA A SCREW-TYPE ANCHOR

[76] Inventor: James D. Brown, 120 Woodland Dr., Greenville, Ala. 36037

[21] Appl. No.: 09/135,433

[22] Filed: Aug. 17, 1998

[51] Int. Cl.[7] ..... B63B 21/52

[52] U.S. Cl. ..... 441/6; 114/295

[58] Field of Search ..... 441/6, 7, 1, 2; 114/295; 52/155, 157

[56] References Cited

U.S. PATENT DOCUMENTS

| | | | |
|---|---|---|---|
| 2,999,572 | 9/1961 | Hinckley | 114/295 |
| 3,315,629 | 4/1967 | Standridge et al. | 441/6 |
| 3,318,058 | 5/1967 | Sullivan | 52/157 |
| 3,408,669 | 11/1968 | Mott | 441/6 |
| 3,830,315 | 8/1974 | Love | 52/157 |
| 3,832,861 | 9/1974 | Jahnke et al. | 52/157 |
| 4,215,544 | 8/1980 | Stanwick | 114/295 |

*Primary Examiner*—S. Joseph Morano
*Assistant Examiner*—Lars A. Olson
*Attorney, Agent, or Firm*—George A. Bode; Lisa D. Charouel; Bode & Associates

[57] ABSTRACT

A buoy drilling anchoring system including a retrievable buoy anchoring drilling device and at least one anchorable marker buoy assembly anchorable into the earth's surface underwater. The retrievable buoy anchoring drilling device is adapted to anchor in the earth's surface underwater at least one anchorable marker buoy assembly having an earth penetratable anchor and is retrievable from underwater after the anchorable marker buoy assembly is anchored for subsequent use thereof. Thereby, a single retrievable buoy anchoring drilling device can be used to anchor a plurality of anchorable marker buoy assemblies such as used to mark the underwater locations for placement of cables or pipelines such as without limitation, a gas pipeline and an oil pipeline.

18 Claims, 6 Drawing Sheets

METHOD AND SYSTEM FOR ANCHORING A BUOY VIA A SCREW-TYPE ANCHOR

BACKGROUND OF THE INVENTION

1. Field of the Invention

The present invention relates to buoys and, more particularly, to a buoy drilling anchoring system including a retrievable buoy anchoring drilling device and at least one anchorable marker buoy assembly anchorable into the earth's surface underwater. The retrievable buoy anchoring drilling device is adapted to anchor in the earth's surface underwater at least one anchorable marker buoy assembly having an earth penetratable anchor means and is retrievable from underwater after the anchorable marker buoy assembly is anchored for subsequent use thereof. Thereby, a single retrievable buoy anchoring drilling device can be used to anchor a plurality of anchorable marker buoy assemblies such as used to mark the underwater locations for placement of cables or pipelines such as without limitation, a gas pipeline and an oil pipeline.

2. General Background

Marker buoys have been deployed to mark locations in a fluid medium. Some marker buoys merely float in water to mark a location but have no means to be secured to a particular underwater location to fixedly mark such location. The buoyant properties of the marker buoys, which are not fixedly secured to a underwater location, can not maintain a particular underwater location due to water turbulence and/or flow pattern.

Other marker buoys used presently used to mark locations for cable or pipeline laying, often utilize weights such as cement blocks to anchor the marker buoys. In the past, if the cement blocks were not retrieved from the earth's surface underwater, nets of fisherman and trawlers can be damaged when passed over the cement blocks.

Another drawback with conventional marker buoys using cement blocks, as an anchoring means, is that 50,000 buoys may be required to adequately mark the locations for placing the cable or pipeline on the earth's surface underwater. As can be readily seen, the vessel used to deploy the 50,000 mark buoys must be of a sufficient size to store 50,000 cement blocks. Furthermore, the labors can become quickly fatigued or injury when dropping overboard the cement blocks of the 50,000 buoys. Nevertheless, retrieving the cement blocks can be hazardous.

Several apparatuses have been patented which are aimed at anchoring drilling devices which anchor into the earth's surface underwater an earth penetratable anchor. However, most of the patents are for anchoring pipelines into the earth's surface underwater.

U.S. Pat. No. 3,427,812, issued to Hollander, entitled "METHOD AND APPARATUS FOR ANCHORING OFFSHORE PIPELINES" discloses an apparatus for securing a pipe to the earthen surface underlying a body of water. The apparatus includes an anchor-driving device or driver and an anchoring assembly adapted to be coupled to the anchor-driving device.

U.S. Pat. No. 3,841,105, issued to Cannon, entitled "METHOD AND APPARATUS FOR ANCHORING UNDERWATER PIPELINES"; U.S. Pat. No. 3,479,830, issued to Ostarly, entitled "ANCHORING MACHINE"; U.S. Pat. No. 4,389,034, issued to Suttles, entitled "UNDERWATER PIPE ANCHORING DEVICE"; U.S. Pat. No. 4,492,493, issued to "PIPELINE ANCHOR HOOK"; and, U.S. Pat. No. 5,730,552, issued to Johannesson et al., entitled "PIPELINE ANCHOR APPARATUS" also disclose the use of screw-type anchors which are screwed into the earth's surface underwater.

Other patents in the art include U.S. Pat. No. 4,265,566, issued to Scodino, entitled "APPARATUS FOR SUPPORTING PIPES SUSPENDED OVER DEPRESSIONS IN THE SEA BED, INCLUDING THOSE SITUATED AT GREAT DEPTH, AND THE METHOD FOR INSTALLING IT"; U.S. Pat. No. 4,626,330, issued to Farmer, entitled "TORSIONALLY INSTALLED ANODE AND EARTH ANCHOR/PENETRATOR"; and, U.S. Pat. No. 5,653,069, issued to Dziedzic, entitled "TUBULAR SOCKET DRIVE EARTH ANCHOR" all of which disclose various types of anchors driven into the earth's surface underwater. However, none of the above teach a buoy drilling anchoring system including a retrievable buoy anchoring drilling device and at least one anchorable marker buoy assembly anchorable into the earth's surface underwater. Furthermore, none of the above teach that the retrievable buoy anchoring drilling device is adapted to anchor in the earth's surface underwater at least one anchorable marker buoy assembly having an earth penetratable anchor means and is retrievable from underwater after the anchorable marker buoy assembly is anchored for subsequent use thereof. Thereby, a single retrievable buoy anchoring drilling device can be used to anchor a plurality of anchorable marker buoy assemblies such as used to mark the underwater locations for placement of cables or pipelines such as without limitation, a gas pipeline and an oil pipeline.

As will be seen more fully below, the present invention is substantially different in structure, methodology and approach from that of known marker buoys.

SUMMARY OF THE PRESENT INVENTION

The preferred embodiment of the buoy drilling anchoring system and method of anchoring a buoy underwater of the present invention solves the aforementioned problems in a straight forward and simple manner. What is provided is a buoy drilling anchoring system including a retrievable buoy anchoring drilling device and at least one anchorable marker buoy assembly anchorable into the earth's surface underwater. The retrievable buoy anchoring drilling device is adapted to anchor in the earth's surface underwater at least one anchorable marker buoy assembly having an earth penetratable anchor means and is retrievable from underwater after the anchorable marker buoy assembly is anchored for subsequent use thereof. Thereby, a single retrievable buoy anchoring drilling device can be used to anchor a plurality of anchorable marker buoy assemblies such as used to mark the underwater locations for placement of cables or pipelines such as without limitation, a gas pipeline and an oil pipeline.

The buoy drilling anchoring system of the present invention comprises: an anchorable marker buoy assembly, said anchorable marker buoy assembly including a floatation buoy member, an earth penetratable means for anchoring and a support line coupled to said earth penetratable anchor means and said floatation buoy member; a retrievable buoy anchoring drilling device detachable coupled to said anchorable marker buoy assembly and constructed and arranged to drive said earth penetratable anchoring means in earth's surface underwater; and, a quick disconnect coupler constructed and arranged to simultaneously detach retrievable buoy anchoring drilling device from said floatation buoy member and release said support line for upward floatation above water of said floatation buoy member to mark a predetermined location.

What is further provided is a method of anchoring an anchorable marker buoy assembly to mark a particular location underwater. The method of the present invention comprises the steps of:

(a) dropping overboard a buoy drilling anchoring system comprising an anchorable marker buoy assembly, said anchorable marker buoy assembly including a floatation buoy member, an earth penetratable means for anchoring and a support line coupled to said earth penetratable anchor means and said floatation buoy member; a retrievable buoy anchoring drilling device detachable coupled to said anchorable marker buoy assembly and constructed and arranged to drive said earth penetratable anchoring means in earth's surface underwater; and, a quick disconnect coupler constructed and arranged to simultaneously detach retrievable buoy anchoring drilling device from said floatation buoy member and release said support line for upward floatation above water of said floatation buoy member to mark a predetermined location.

(b) activating a drill assembly of said retrievable buoy anchoring drilling device after a predetermined time delay;

(c) drilling and anchoring said earth penetratable anchor means into the earth's surface;

(d) retrieving said retrievable buoy anchoring drilling device;

(e) simultaneously with the step (d), disconnecting said retrievable buoy anchoring drilling device from said anchorable marker buoy assembly via said a quick disconnect coupler; and, (f) simultaneously with the step (d), automatically deploying said floatation buoy member to a top surface of water from underwater.

Furthermore, the step of (f) includes the step of automatically unwinding said support line and freely floating said floatation buoy member to said top surface of the water from underwater.

In view of the above, it is an object of the present invention to provide a buoy drilling anchoring system which includes a retrievable buoy anchoring drilling device and at least one anchorable marker buoy assembly having a earth penetratable anchoring means which penetrates the earth's surface underwater under the driving force of the retrievable buoy anchoring drilling device. Whereby, the use of an earth penetratable anchoring means, having a relatively low weight in comparison to heavier cement blocks, which is capable of withstanding at least 400 lbs. of vertical pull to fixedly mark a particular location underwater. Thereby, the overall space and weight requirement for a single marker buoy assembly is minimized while still providing the capability of anchoring such marker buoy to the earth's surface underwater.

Another object of the invention is to provide a single retrievable buoy anchoring drilling device which can be used to deploy thousands of anchorable marker buoy assemblies each of which includes, in the preferred embodiment, a 1 lb. earth penetratable anchor means capable of withstanding at least 400 lbs. of vertical pull.

A further object of the present invention is to provide the buoy drilling anchoring system with a retrievable buoy anchoring drilling device which includes a permanent buoy and retrieve line assembly wherein the permanent buoy and retrieve line assembly serves to (1) mark the location of the retrievable buoy anchoring drilling device underwater; (2) allow the retrievable buoy anchoring drilling device be retrieved (lifted) via the retrieve line; and, (3) orientates the retrievable buoy anchoring drilling device into a vertically upright position by virtue of the vertical pull exerted on the permanent buoy and retrieve line assembly.

It is a still further object of the present invention to provide a buoy drilling anchoring system which includes a retrievable buoy anchoring drilling device which includes a permanent buoy and retrieve line assembly and at least one detachable anchorable marker buoy assembly having an earth penetratable anchor means (which is adapted to be anchored into the earth's surface underwater).

It is a further object of the present invention to provide a buoy drilling anchoring system having a retrievable buoy anchoring drilling device which includes a support base, a center weight coupled to the support base, a vertically upright support frame and a drill assembly which drills the earth penetratable anchor means into the earth's surface underwater. The center weight serves to provide sufficient weight for the rapid downward (sinking) movement of the retrievable buoy anchoring drilling device to the earth's surface underwater.

In view of the above objects, it is a feature of the present invention to provide a buoy drilling anchoring system which is relatively simple structurally and thus simple to manufacture.

Another feature of the present invention is to provide a buoy drilling anchoring system which is reusable and easily and effortlessly retrievable from under the water.

It is another feature of the present invention to provide a buoy drilling anchoring system which is simple to operate to anchor at least one anchorable marker buoy assembly. More specifically, the buoy drilling anchoring system requires a power switch to be turned on and the buoy drilling anchoring system dropped overboard.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
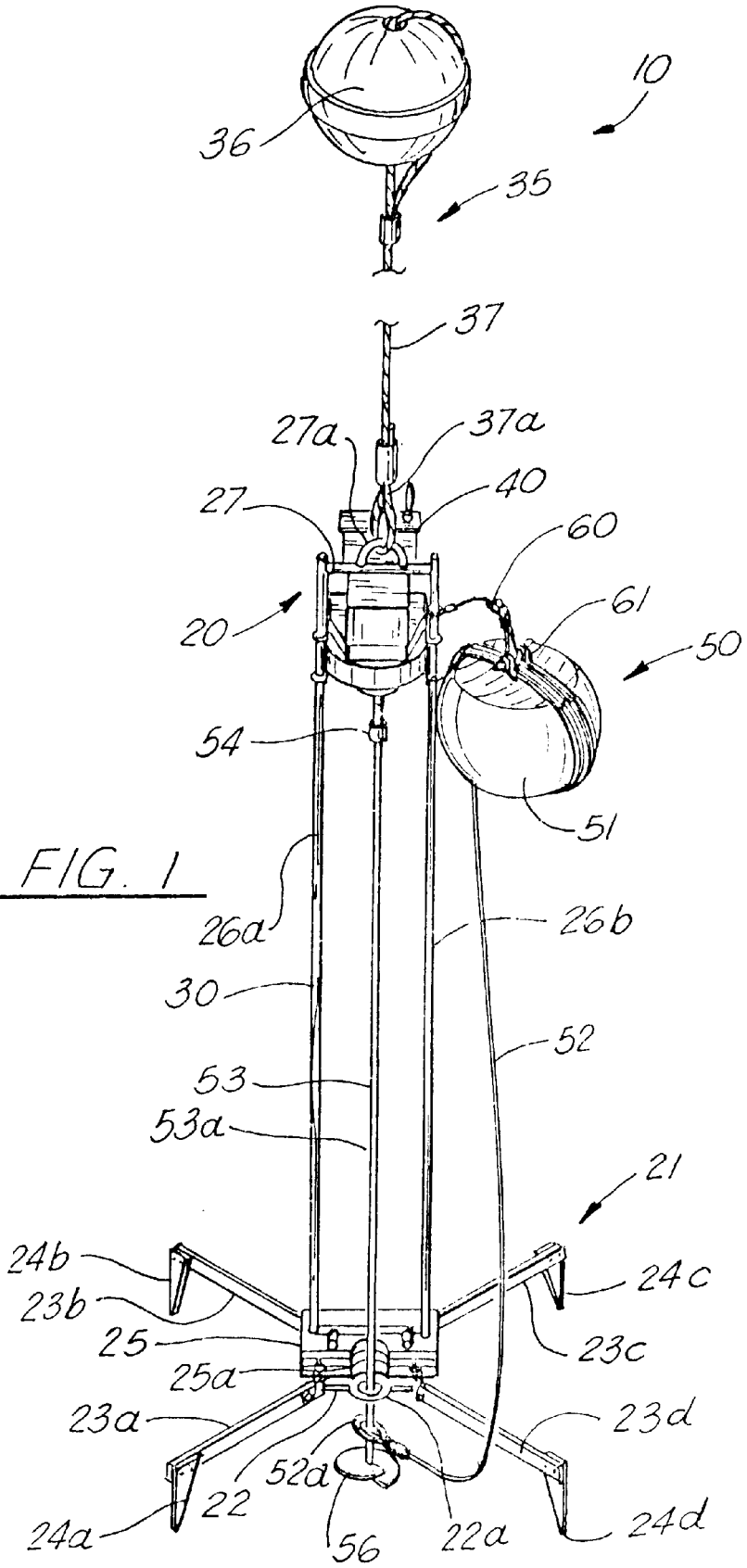
FIG. 1 illustrates a perspective view of the buoy drilling anchoring system of the present invention.

Referring now to the drawing, and in particular FIG. 1, the buoy drilling anchoring system of the present invention is designated generally by the numeral 10. Buoy drilling anchoring system 10 is easily deploy by simply dropping buoy drilling anchoring system 10 overboard from the side of vessel 5. Buoy drilling anchoring system 10 is generally comprised of retrievable buoy anchoring drilling device 20, at least one anchorable marker buoy assembly 50 and quick disconnect coupler 60.

Retrievable buoy anchoring drilling device 20 comprises in general support base 21, center weight 25, vertically upright support frame 30, permanent buoy and retrieve line assembly 35 and drill assembly 40. Support base 21 includes center section 22 and a plurality of hinged radial support members 23*a*, 23*b*, 23*c* and 23*d* radially extending along the horizontal plane from center section 22. The plurality of hinged radial support members 23*a*, 23*b*, 23*c* and 23*d* are hingely coupled to center section 22 so that when retrievable buoy anchoring drilling device 20 is dropped overboard, any one of the plurality of hinged radial support members 23*a*, 23*b*, 23*c* and 23*d* is free to pivot so that vessel 5 or any of the plurality of hinged radial support members 23*a*, 23*b*, 23*c* and 23*d* do not become damaged.

Figure 3:
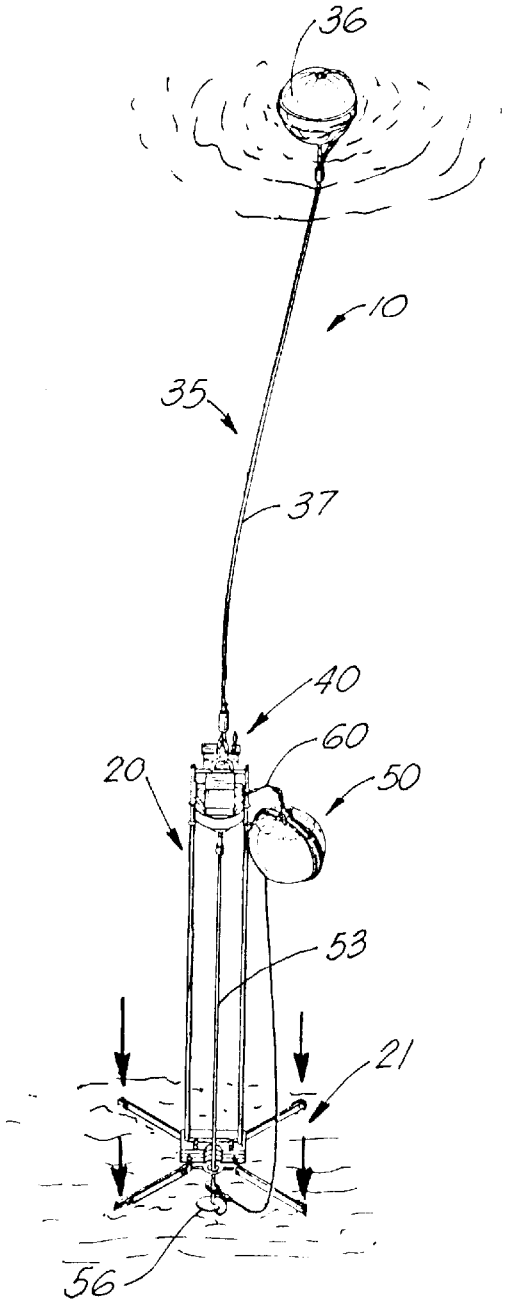
FIG. 3 illustrates a perspective view of the buoy drilling anchoring system sunken to the underwater earth surface with the retrievable buoy afloat.
Figure 5:
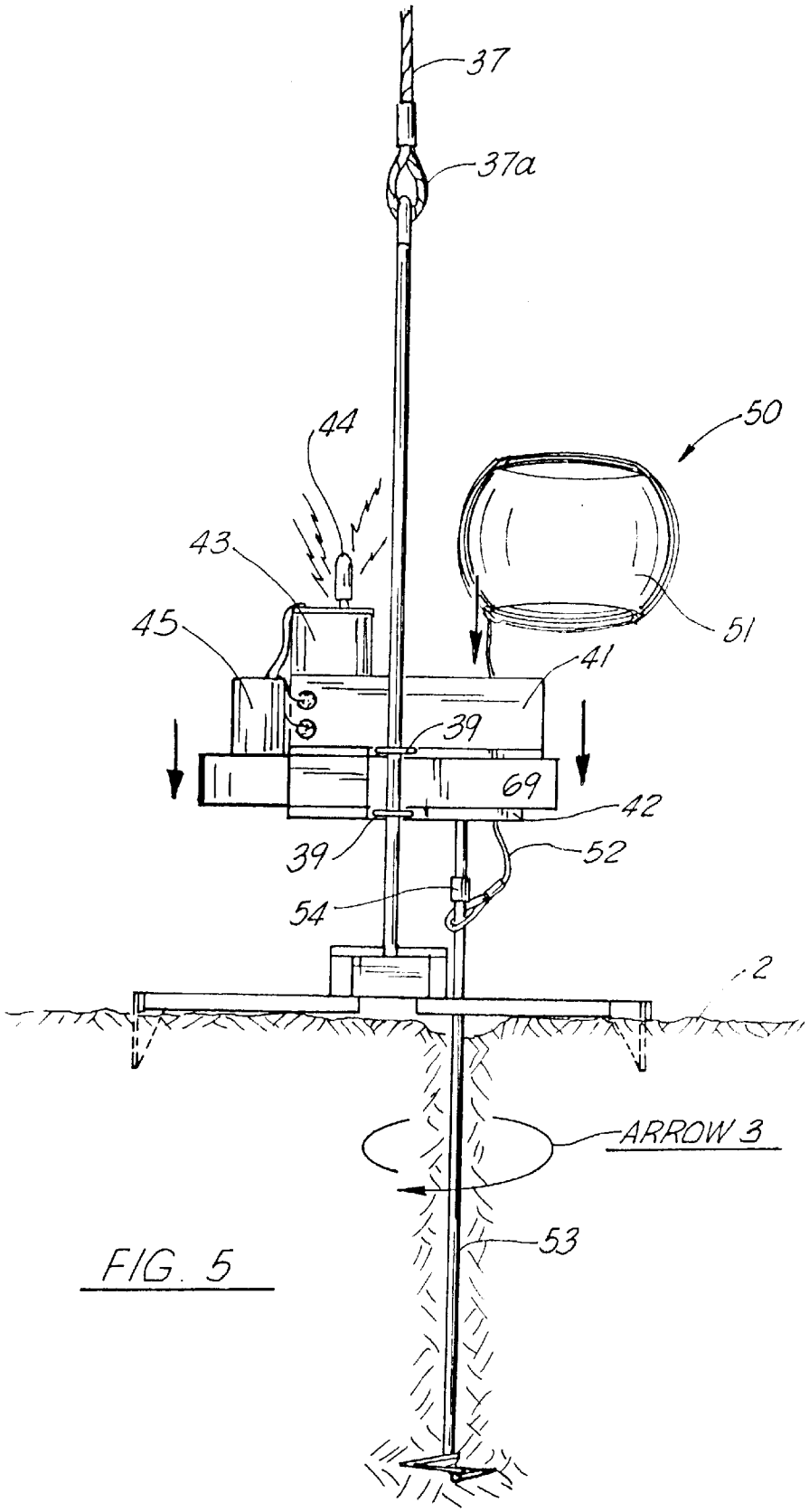
FIG. 5 illustrates a side perspective view of the buoy drilling anchoring system drilling the anchor of the marker buoy of the present invention.

The free ends of the plurality of hinged radial support members 23*a*, 23*b*, 23*c* and 23*d* each has coupled thereto spike member 24*a*, 24*b*, 24*c* and 24*d*, respectively. In the exemplary embodiment, spike member 24*a*, 24*b*, 24*c* and 24*d* are triangularly shaped with the base of the triangularly shaped spike member being coupled to the free end. As can be appreciated, the tapering sides of spike members 24*a*, 24*b*, 24*c* and 24*d* serves to allow spike members 24*a*, 24*b*, 24*c* and 24*d* to embed themselves into the earth's surface, as best seen in FIGS. 3 and 5.

Vertically upright support frame 25 includes two parallel vertically extending support rod members 26*a* and 26*b* and cross connecting rod member 27. The top ends of the two parallel vertically extending support rod members 26*a* and 26*b* have coupled thereto cross connecting rod member 27 which maintains the two parallel vertically extending support rod members 26*a* and 26*b* in parallel spaced relation. The bottom free ends of parallel vertically extending support rod members 26*a* and 26*b* are coupled to center section 22 of support base 21.

The two parallel vertically extending support rod members 26*a* and 26*b* serve to slidably support thereon drill assembly 40 wherein as drill assembly 40 drills the earth penetratable anchor means 53 into the earth's surface underwater, drill assembly 40 slides downward along the two parallel vertically extending support rod members 26*a* and 26*b*. In the center of cross connecting rod member 27 there is provided eyelet 27*a* for fixedly attaching thereto permanent buoy and retrieve line assembly 35.

Permanent buoy and retrieve line assembly 35 comprises buoy 36 and retrieve line 37. Retrieve line 37 is fixedly coupled to eyelet 27*a* via loop 37*a* formed in one free end of retrieve line 37 and the other free end is fixedly coupled to buoy 36. When retrievable buoy anchoring drilling device 20 is dropped overboard, permanent buoy and retrieve line assembly 35 serves to (1) mark the location of the retrievable buoy anchoring drilling device underwater; (2) allow the retrievable buoy anchoring drilling device be retrieved (lifted) via the retrieve line; and, (3) orientate the retrievable buoy anchoring drilling device into a vertically upright position by virtue of the vertical pull exerted on retrieve line 37.

Center weight 25 is coupled to center section 22 of support base 21 so as to weight retrievable buoy anchoring drilling device 20 for rapid downward (sinking) movement thereof underwater to the earth's surface 2. Center weight 25 has formed therein an recess 25*a* and center section 22 has formed therein aperture 22*a* for journalling therethrough earth penetratable anchoring means 53.

Drill assembly 40 comprises motor means 45, driver 42, gear box 69, timing mechanism 43, power switch 44 and battery source 41. In operation, when power switch 44 is turned on power from battery source 41 is delivered to timing mechanism 43 to begin counting a predetermined timing delay wherein such delay is a sufficient amount of time to allow retrievable buoy anchoring drilling device 20 to sink to the earth's surface 2 underwater. This delay is necessary so that the drilling process does not begin until retrievable buoy anchoring drilling device 20 has fully sunk to the earth's surface 2 underwater, as best seen in FIG. 3. After the commencement of the predetermined timing delay, timing mechanism 43 sends a control signal to activate motor means 45 which in turn drives driver 42 via gear box 69.

Figure 4:
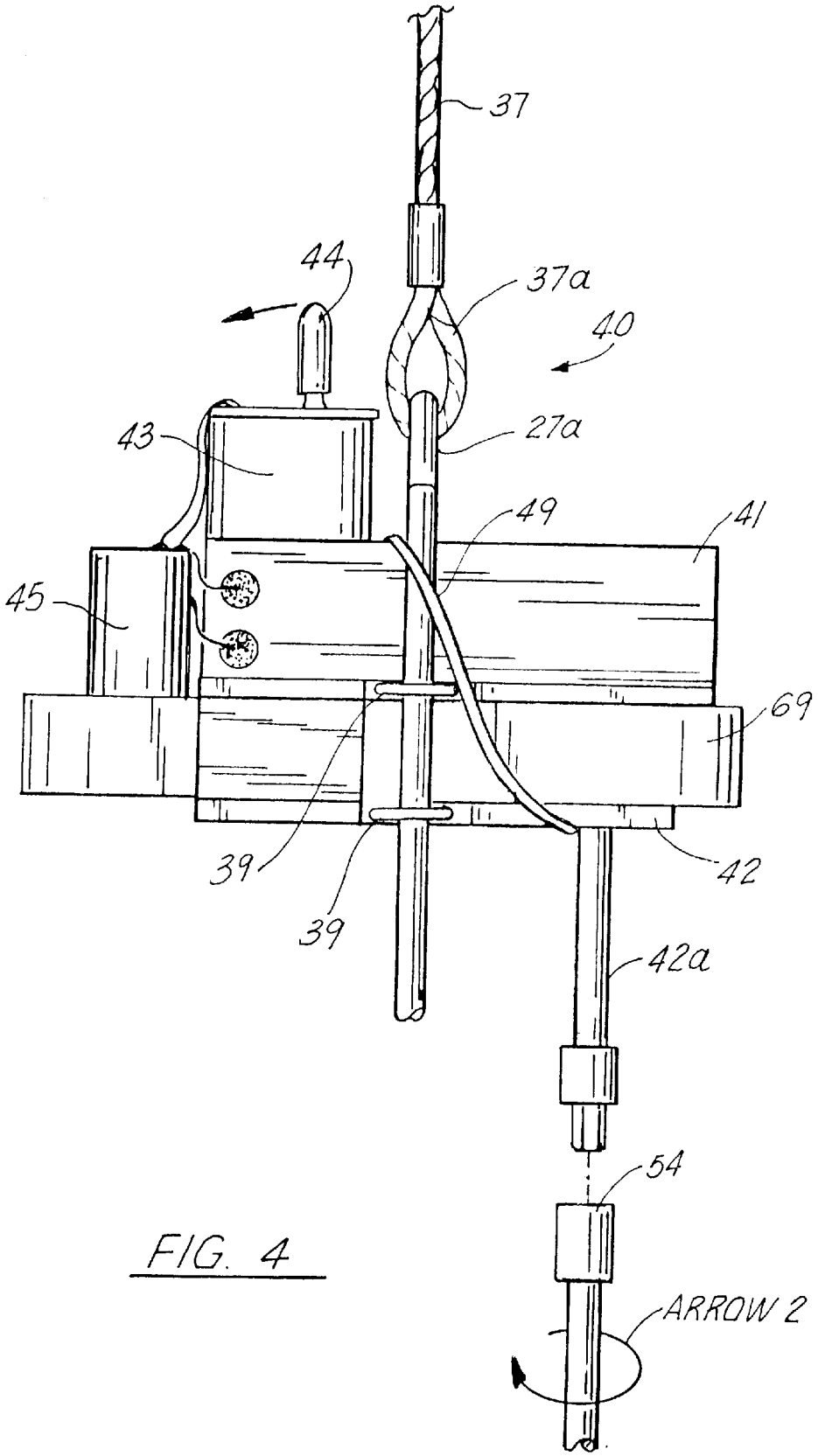
FIG. 4 illustrates a side view of the drilling assembly of the present invention.
Figure 6:
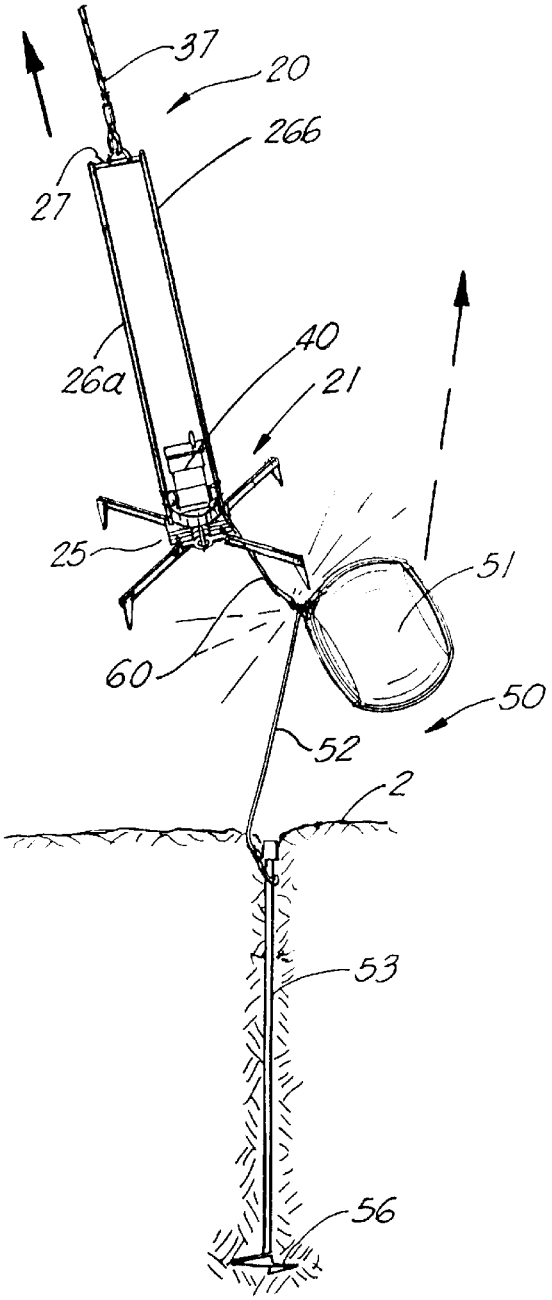
FIG. 6 illustrates a perspective view of the a retrievable buoy anchoring drilling device of the buoy drilling anchoring system being retrieved.
Figure 7:
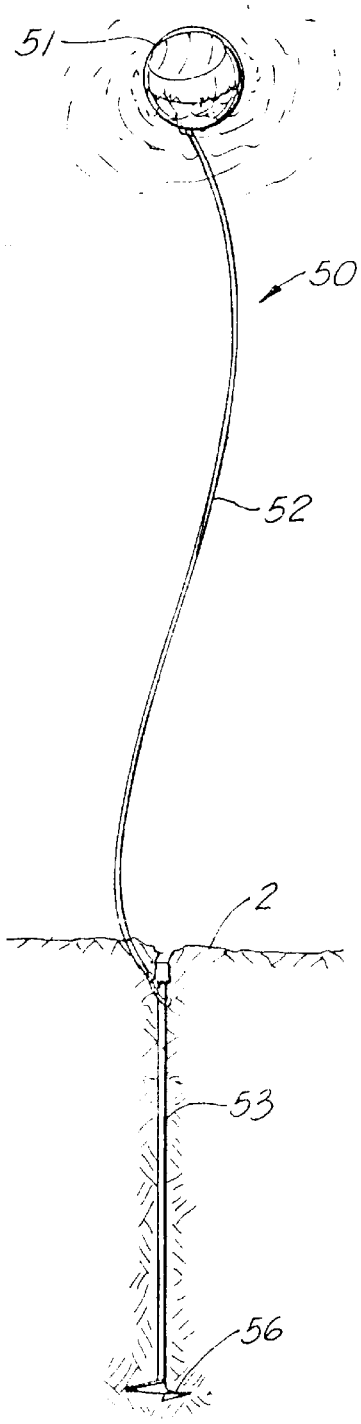
FIG. 7 illustrates a perspective view of the anchored marker buoy assembly afloat; and, FIG. 8 depicts a front view of a portion of the drilling assembly of the present invention illustrating how band (49) holds the metal plate to the gear box (69).
Figure 8:
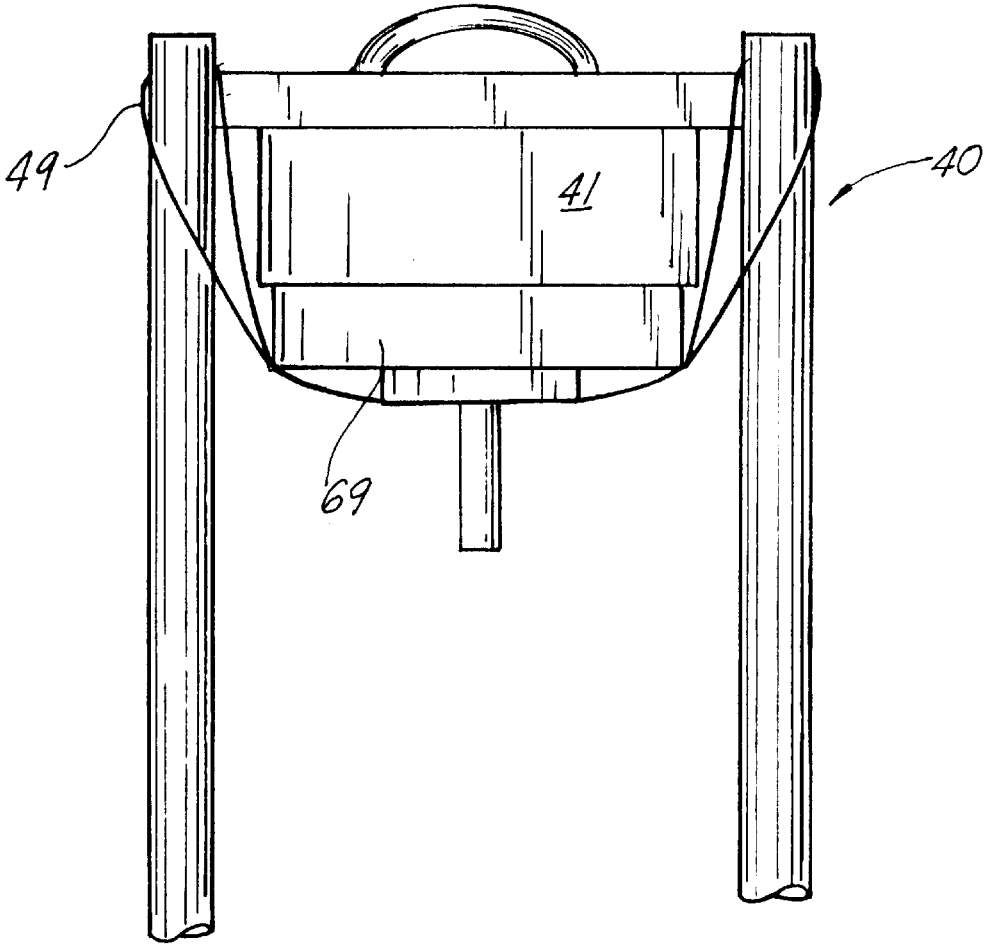

Driver 42 rotates drill rod member 42*a* which in turn rotates earth penetratable anchoring means 53 of anchorable marker buoy assembly 50 in the direction of ARROWS 2 and 3, as best seen in FIGS. 4 and 5. Drill assembly 40 is pre-positioned at the top of the two parallel vertically extending support rod members 26*a* and 26*b* by rubber band member 49. When the unit begins to drill, rubber band member 49 is snared by the nuts/bolts holding the round metal plate to gear box 69. Rubber band member 49 is then stretched to its breaking point and is thus automatically severed when driver 42 begins to rotate after the predetermined time delay. Thereby, drill assembly 40 is capable of sliding downward along the two parallel vertically extending support rod members 26*a* and 26*b* via slid coupler 39 to anchor earth penetratable anchoring means 53 deep into the earth's surface 2 underwater, as best seen in FIGS. 5–7.

Band member 49 serves to maintain drill assembly 40 in the desired start position located at the top of the two parallel vertically extending support rod members 26*a* and 26*b* as retrievable buoy anchoring drilling device 20 sinks to the earth's surface underwater. Thereby, when drill assembly 40 begins the drilling process to anchor earth penetratable anchoring means 53, drill assembly 40 is positioned at the desired start position. The length of the two parallel vertically extending support rod members 26*a* and 26*b* should be sufficient to accommodate the height of drill assembly 40 and a substantial portion of the length of earth penetratable anchoring means 53, as best seen in FIG. 1.

Timing mechanism 43 maintains the power to motor means 41 which turns driver 42 for a predetermined drilling time interval. The predetermined drilling time interval should be of a sufficient duration to drill the desired length of earth penetratable anchoring means 53 into the earth's surface 2, as best seen in FIGS. 5–7.

Anchorable marker buoy assembly 50 is generally comprised of floatation marker buoy 51, support line 52, earth penetratable anchoring means 53 and drill coupler 54. Anchorable marker buoy assembly 50 has a non-anchored state and a marking state. When anchorable marker buoy assembly 50 is in the pre-anchored state support line 52 is wrapped around floatation marker buoy 51 so that very little vertical pull is exerted on the support line 52 and flotation marker buoy 51 is forced underwater under the weight of retrievable buoy anchoring drilling device 20. As can be appreciated, when anchorable marker buoy assembly 50 is in its per-anchored state underwater, anchorable marker buoy assembly 50 is not visible at the top surface of the water.

In the preferred embodiment, earth penetratable anchoring means 53 is an auger or screw-type anchor. Earth penetratable anchoring means 53 comprises shaft portion 53*a* having at least one helix 56 coupled to the lower end of shaft portion 53*a*. The top end of shaft portion 53*a* has fixedly coupled thereto drill coupler 54 for coupling earth penetratable anchoring means 53 to drill rod member 42*a*. Although, the auger or screw-type anchor as the earth penetratable anchoring means is preferred, other types of earth penetratable anchor constructions, such as, without limitation, a torsionally driven earth penetrator anchor may be substituted.

Floatation marker buoy 51 is a generally spherically shaped member made of a buoyant material. Support line 52 has one free end formed into loop 52*a* and serves to allow support line 52 to slid along shaft portion 53*a* earth penetratable anchoring means 53. The size of loop 52*a* is such that line 52 is free to slid along shaft portion 53*a* as floatation marker buoy 51 floats upward to the top of the water and into its marking state without allowing loop 52*a* to slip off of shaft portion 53*a*.

Figure 2:
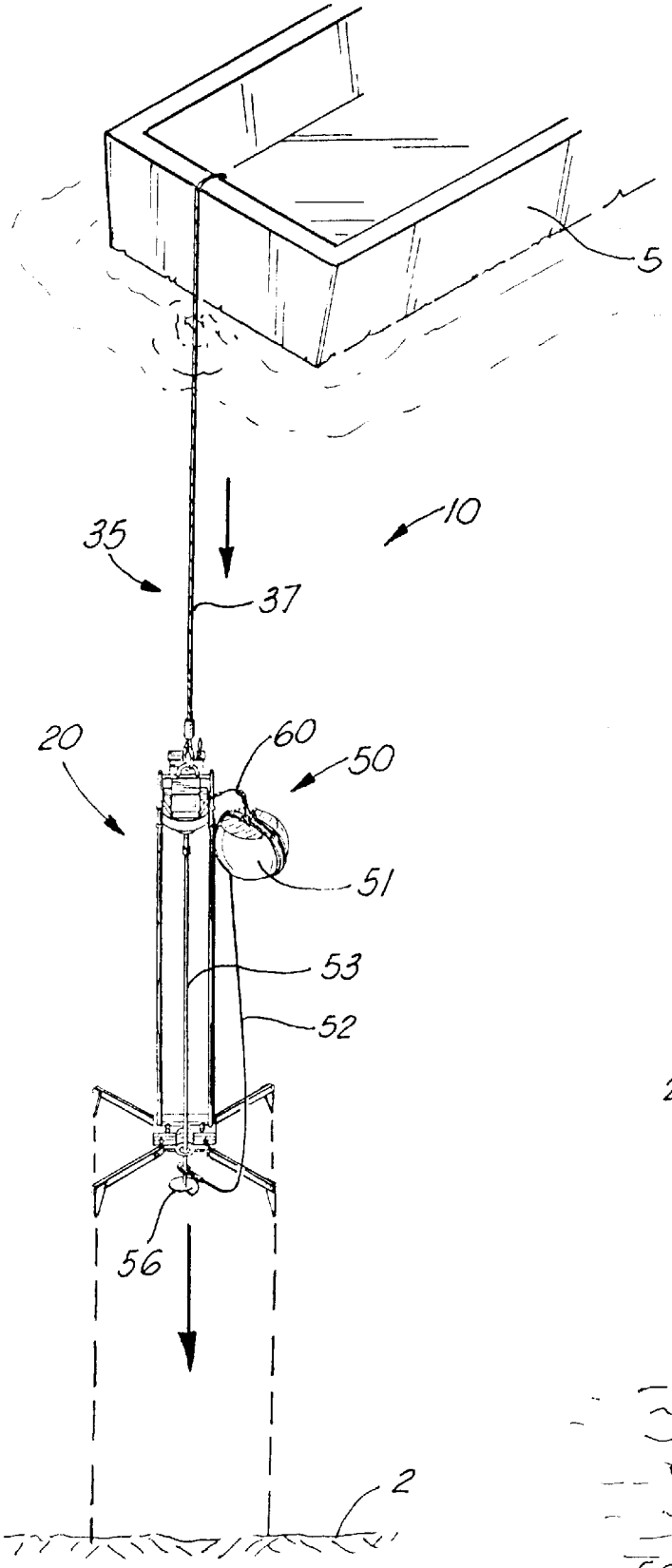
FIG. 2 illustrates a perspective view of buoy drilling anchoring system of the present invention being dropped overboard.

In operation, the detachable anchorable marker buoy assembly, in its pre-anchored state, as best seen in FIGS. 1 and 2, is adapted to sink downward under the weight of retrievable buoy anchoring drilling device 20 and is not free to float on the top surface of the water since support line 52 is wrapped around floatation marker buoy 51. Only after the detachable anchorable marker buoy assembly 50 is anchored into the earth's surface underwater and when the retrievable buoy anchoring drilling device 20 is retrieved from underwater, support line 52 of the detachable anchorable marker buoy assembly 50 is released by virtue of the removal of quick disconnect coupler 60.

Quick disconnect coupler 60 serves to detach quickly retrievable buoy anchoring drilling device 20 from anchorable marker buoy assembly 50 and simultaneously free support line 52 so that support line 52 is free to unwind. After anchorable marker buoy assembly 50 is anchored into the earth's surface 2, retrievable buoy anchoring drilling device 20 is simultaneously retrieved and disconnected (detached) from anchorable marker buoy assembly 50. When disconnecting retrievable buoy anchoring drilling device 20 from anchorable marker buoy assembly 50 quick disconnect coupler 60 breaks securing band 61 thereby releasing the attachment of anchorable marker buoy assembly 50 and allows the wrapped support line 52 to freely unwind by virtue of the buoyant properties of floatation marker buoy 51. As can be readily seen, floatation marker buoy 51 is deployed to mark a particular location from underwater wherein when support line 52 is release, floatation marker buoy 51 quickly floats upward to the top surface of the water. The location of the floatation marker buoy 51 is fixed by virtue of the earth penetratable anchoring means 53.

When anchoring anchorable maker buoy assembly 50, only buoy 36 of retrievable buoy anchoring drilling device 20 is afloat above water. Retrievable buoy anchoring drilling device 20 floats downward under the weight of center weight 25 to the underwater earth's surface 2.

Motor means 41 is not activated until the predetermined time delay has commenced. In the preferred embodiment, the predetermined time delay is approximately 30 seconds. Nevertheless, other time intervals may be used depending on the particular depth of the water. The predetermined time delay should be sufficient to allow buoy drilling anchoring system 10 to completely float to the underwater earth's surface 2 and position itself in the vertical upright posture. Thereafter, power is supplied to motor means 41 for a predetermined drilling time interval. In the preferred embodiment, the predetermined drilling time interval is approximately 3 minutes. The predetermined drilling time interval is dependent on several factors such as the length of shaft portion 53*a* and the amount of such length to be drilled in the underwater earth's surface 2 and the speed of the motor means 41.

After the predetermined drilling time interval has commenced, retrievable buoy anchoring drilling device 20 is retrieved from underwater by merely pulling on retrieve line 37 coupled to permanent buoy 36. As retrievable buoy anchoring drilling device 20 is retrieved, anchorable marker buoy assembly 50 having been anchored into the underwater earth's surface 2 is disconnected (detached) from retrievable buoy anchoring drilling device 20 and left anchored in the water to mark the particular location. Retrievable buoy anchoring drilling device 20 having been disconnected from anchorable marker buoy assembly 50 is retrieved back into vessel 5. Henceforth, retrievable buoy anchoring drilling device 20 can be reused for the anchoring of subsequent anchorable marker buoy assemblies 50.

As can be appreciated, a single retrievable buoy anchoring drilling device 20 can be used to anchor a plurality of anchorable marker buoy assemblies 50. Henceforth, vessel 5 need only have the capacity to store a single retrievable buoy anchoring drilling device 20 and a plurality of anchorable marker buoy assemblies 50. My buoy drilling anchoring system 10 requires significantly less storage space in the vessel 5.

In the preferred embodiment, retrievable buoy anchoring drilling device 20 weighs about 18 lb. and earth penetratable anchoring means 53 (a screw-type anchor) weights approximately 1 lb. The 1 lb. earth penetratable anchoring means 53 can withstand at least 400 lbs. of vertical pull. Support line 52 is preferable a 900 lb. line. When floatation marker buoy 51 is retrieved approximately 10 knots by snarling floatation marker buoy 51 by the pull of vessel 5 is required to pull earth penetratable anchoring means 53 out of the earth surface and thus retrieve anchorable maker buoy assembly 50. Thereby, the plurality of marker buoys and their respective anchors are retrievable and reusable.

Retrievable buoy anchoring drilling device 20 and thousands of anchorable marker buoy assemblies 50 are capable of being stored in a relatively small area in vessel 5 in comparison to the space requirements to store cement block anchors of the prior systems.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A buoy drilling anchoring system comprising:

(a) an anchorable marker buoy assembly, said anchorable marker buoy assembly including a floatation buoy member, an earth penetratable means for anchoring and a support line coupled to said earth penetratable anchor means and said floatation buoy member;

(b) a retrievable buoy anchoring drilling device detachable coupled to said anchorable marker buoy assembly and constructed and arranged to drive said earth penetratable anchoring means in earth's surface underwater; and, (c) a quick disconnect coupler constructed and arranged to simultaneously detach retrievable buoy anchoring drilling device from said floatation buoy member and release said support line for upward floatation above water of said floatation buoy member to mark a predetermined location.

2. The buoy drilling anchoring system of claim 1, wherein said retrievable buoy anchoring drilling device comprises:

a support base having center section and a plurality of hinged radial support members radially extending along a horizontal plane from said center section and a plurality of spike member coupled to free ends of said plurality of hinged radial support members;

a center weight coupled in a center of said support base;

a vertically upright support frame coupled perpendicularly to said center section; and, a drill assembly slidably coupled to said vertically upright support frame and constructed and arranged to drive said earth penetratable anchoring means in said earth's surface underwater.

3. The buoy drilling anchoring system of claim 2, wherein said retrievable buoy anchoring drilling device further comprises a permanent buoy and retrieve line assembly, said permanent buoy and retrieve line assembly comprises a permanent buoy and a retrieve line fixedly coupled to said vertically upright support frame and said permanently buoy.

4. The buoy drilling anchoring system of claim 3, wherein said permanent buoy and retrieve line assembly functions to (1) mark a location of said retrievable buoy anchoring drilling device underwater; (2) allow said retrievable buoy anchoring drilling device to be retrieved via said retrieve line; and, (3) orientate said retrievable buoy anchoring drilling device into a vertically upright position by virtue of vertical pull force exerted on the retrieve line.

5. The buoy drilling anchoring system of claim 2, wherein said drill assembly comprises a motor, a driver, a timing mechanism, a power switch and a battery source wherein when said power switch is turned to an on state, power is delivered to said motor after a predetermined time delay has commenced to rotate said driver.

6. The buoy drilling anchoring system of claim 5, wherein said drill assembly is pre-positioned in a top portion of said vertically upright support frame and maintained in said top portion by a band member adapted to be severed when said driver rotates.

7. The buoy drilling anchoring system of claim 1, wherein said earth penetratable anchoring means is an auger or a screw-type anchor.

8. A buoy drilling anchoring system comprising:

(a) an anchorable marker buoy assembly, said anchorable marker buoy assembly including a floatation buoy member, an earth penetratable means for anchoring and a support line coupled to said earth penetratable anchor means and said floatation buoy member;

(b) a retrievable buoy anchoring drilling device detachable coupled to said anchorable marker buoy assembly and constructed and arranged to drive said earth penetratable anchoring means in earth's surface underwater wherein said retrievable buoy anchoring drilling device comprises permanent buoy and retrieve line assembly; and, (c) a quick disconnect coupler constructed and arranged to simultaneously detach retrievable buoy anchoring drilling device from said floatation buoy member and release said support line for upward floatation above water of said floatation buoy member to mark a predetermined location when said retrievable buoy anchoring drilling device is retrieved from underwater by said permanent buoy and retrieve line assembly.

9. The buoy drilling anchoring system of claim 8, wherein said retrievable buoy anchoring drilling device further comprises:

a support base having center section and a plurality of hinged radial support members radially extending along a horizontal plane from said center section and a plurality of spike member coupled to free ends of said plurality of hinged radial support members;

a center weight coupled in a center of said support base;

a vertically upright support frame coupled perpendicularly to said center section; and, a drill assembly slidably coupled to said vertically upright support frame and constructed and arranged to drive said earth penetratable anchoring means in said earth's surface underwater.

10. The buoy drilling anchoring system of claim 9, wherein said permanent buoy and retrieve line assembly functions to (1) mark a location of said retrievable buoy anchoring drilling device underwater; (2) allow said retrievable buoy anchoring drilling device to be retrieved via said retrieve line; and, (3) orientate said vertically upright support frame of said retrievable buoy anchoring drilling device into a vertically upright position by virtue of vertical pull force exerted on the retrieve line.

11. The buoy drilling anchoring system of claim 9, wherein said drill assembly comprises a motor, a driver, a timing mechanism, a power switch and a battery source wherein when said power switch is turned to an on state, power is delivered to said motor after a predetermined time delay has commenced to rotate said driver.

12. The buoy drilling anchoring system of claim 11, wherein said drill assembly is pre-positioned in a top portion of said vertically upright support frame and maintained in said top portion by a band member adapted to be severed when said driver rotates.

13. The buoy drilling anchoring system of claim 8, wherein said earth penetratable anchoring means is an auger or a screw-type anchor.

14. The method of anchoring an anchorable marker buoy assembly to mark a particular location underwater comprises the steps of:

(a) dropping overboard a buoy drilling anchoring system comprising an anchorable marker buoy assembly, said anchorable marker buoy assembly including a floatation buoy member, an earth penetratable means for anchoring and a support line coupled to said earth penetratable anchor means and said floatation buoy member; a retrievable buoy anchoring drilling device detachable coupled to said anchorable marker buoy assembly and constructed and arranged to drive said earth penetratable anchoring means in earth's surface underwater; and, a quick disconnect coupler constructed and arranged to simultaneously detach retrievable buoy anchoring drilling device from said floatation buoy member and release said support line for upward floatation above water of said floatation buoy member to mark a predetermined location, (b) activating a drill assembly of said retrievable buoy anchoring drilling device after a predetermined time delay;

(c) drilling and anchoring said earth penetratable anchor means into the earth's surface;

(d) retrieving said retrievable buoy anchoring drilling device;

(e) simultaneously with the step (d), disconnecting said retrievable buoy anchoring drilling device from said anchorable marker buoy assembly via said a quick disconnect coupler; and, (f) simultaneously with the step (d), automatically deploying said floatation buoy member to a top surface of water from underwater.

15. The method of claim 14, wherein said earth penetratable anchoring means is an auger or a screw-type anchor.

16. The method of claim 14, wherein said predetermined time delay is at least 30 seconds.

17. The method of claim 14, wherein the step of (c) is performed for at least 2 minutes.

18. The method of claim 14, wherein the step of (f) includes the step of automatically unwinding said support line and freely floating said floatation buoy member to said top surface of the water from underwater.

* * * * *